US005967161A

United States Patent [19]

Neal

[11] Patent Number: 5,967,161

[45] Date of Patent: Oct. 19, 1999

[54] FOLDABLE UMBRELLA FAN

[76] Inventor: James R. Neal, 875 William Blvd Apt 2413, Ridgeland, Miss. 39157

[21] Appl. No.: 09/034,292

[22] Filed: Mar. 4, 1998

Related U.S. Application Data

[60] Provisional application No. 60/047,406, May 22, 1997.

[51] Int. Cl.[6] ..... A42B 1/20; A45B 11/04; A45B 19/00; A45B 27/00

[52] U.S. Cl. ..... 135/19.5; 160/84.07; 2/410; 416/70 A

[58] Field of Search ..... 135/16, 19.5, 143; 160/84.07, 134; 2/171.03, 410; D3/2, 5; 416/70 A, 73

[56] References Cited

U.S. PATENT DOCUMENTS

| | | | |
|---|---|---|---|
| 68,890 | 9/1867 | Lucas . | |
| 213,415 | 3/1879 | Halvorson . | |
| 220,427 | 10/1879 | Rubin . | |
| 237,611 | 2/1881 | Scheuer . | |
| 257,950 | 5/1882 | Jordan . | |
| 323,811 | 8/1885 | Hoefle . | |
| 490,532 | 1/1893 | Baer . | |
| 494,032 | 3/1893 | Scheuer . | |
| 519,554 | 5/1894 | Rubin . | |
| 835,433 | 11/1906 | Hulsizer . | |
| 1,533,396 | 4/1925 | Dabney . | |
| 2,136,925 | 11/1938 | Ristell et al. . | |
| 2,147,872 | 2/1939 | Wittcoff . | |
| 2,147,873 | 2/1939 | Wittcoff . | |
| 2,412,415 | 12/1946 | Navon . | |
| 2,495,041 | 1/1950 | Weiss . | |
| 2,864,092 | 12/1958 | Hurst . | |
| 3,441,038 | 4/1969 | Mathews . | |
| 3,452,765 | 7/1969 | Slaton . | |
| 4,312,371 | 1/1982 | Koon . | |
| 4,675,916 | 6/1987 | Orsini . | |
| 4,934,434 | 6/1990 | Schnebly et al. | 160/84.07 |
| 5,002,112 | 3/1991 | Schnebly et al. | 160/84.07 |
| 5,660,220 | 8/1997 | Ruan | 160/84.07 |

FOREIGN PATENT DOCUMENTS

| | | | |
|---|---|---|---|
| 440064 | 10/1948 | Italy | 135/19.5 |

*Primary Examiner*—Robert Canfield
*Attorney, Agent, or Firm*—Richard C. Litman

[57] ABSTRACT

A foldable umbrella fan is constructed of a form-retaining pleated shield and a protective support binder. The pleated shield of the umbrella fan may be fanned open 360° into a full circle for use as an umbrella. Alternatively, the pleated shield may be fanned partially open for use as a fan. The pleated shield also may be fully collapsed to store the closed umbrella fan in a briefcase, handbag, or pocket.

12 Claims, 4 Drawing Sheets

FOLDABLE UMBRELLA FAN

CROSS-REFERENCE TO RELATED PATENT APPLICATION

This application claims the benefit of U.S. provisional patent application Ser. No. 60/047,406, filed May 22, 1997.

BACKGROUND OF THE INVENTION

1. Field of the Invention

The present invention relates to foldable umbrellas and hats, and more particularly to foldable umbrella hats which can also be used as fans.

2. Description of Related Art

Over the years, a wide variety of devices have been utilized by people in an attempt to keep themselves dry outdoors when it is raining, or to shade themselves when it is sunny. Common devices include umbrellas and wide brimmed hats. Umbrellas perform the precipitation-protection function very well under many circumstances and can be collapsed into a moderately low volume configuration. However, many umbrellas require that the user use his or her hands to maintain them in a proper position. Large brimmed hats can also be advantageous; however, they are difficult to store properly and transport from place to place when not needed to protect the wearer.

Various collapsible head coverings have been disclosed which combine the advantageous design features of hats and umbrellas. Examples of devices generally related to this art include U.S. Pat. No. 213,415 (Sun-Helmets) issued March 1879 to Halvorson; U.S. Pat. Nos. 2,147,872 (Head Covering) and 2,147,873 (Head Covering) issued February 1939 to Wittcoff; U.S. Pat. No. 2,412,415 (Combination Umbrella and Cape) issued December 1946 to Navon; U.S. Pat. No. 2,495,041 (Beach or Sun Hat) issued January 1950 to Weiss; U.S. Pat. No. 3,441,038 (Canopy Assemblies) issued April 1969 to Mathews; U.S. Pat. No. 3,452,765 (Device for Protection Against Inclement Weather) issued July 1969 to Slaton; U.S. Pat. No. 4,312,371 (Umbrellas) issued January 1982 to Koon; U.S. Pat. No. 4,675,916 (Umbrella Hat with Elastic Peripheral Components) issued June 1987 to Orsini; France Pat. No. 787,503 (Hat for the Beach) issued September 1935 to Pretot; and Swiss Pat. No. 787,503 (Device for Protection Against Inclement Weather) issued August 1968 to Slaton.

These devices suffer two significant drawbacks. First, even the most compact of the disclosed devices is still so large in its collapsed position that it requires being carried in a large handbag or briefcase. No collapsible head coverings are disclosed which are designed to be carried comfortably in a user's pocket.

Further, no known collapsible head covering is designed to accomplish any additional function which would be advantageous. Specifically, none of the current art head coverings are designed to function as a fan. It is well known that fanning oneself to cool off is particularly desirable during periods of oppressive, high humidity. It is also a well known scientific principle that precipitation occurs during periods of high humidity. Thus, people are most likely to need to fan themselves before or after a rain shower. It follows that it would be advantageous to have an umbrella which also functions as a hand held fan so that a user does not need to carry both.

Therefore, a need still exists for a collapsible umbrella hat which can also be used as a hand-held fan. None of the above inventions and patents, taken either singly or in combination, is seen to describe the instant invention as claimed.

SUMMARY OF THE INVENTION

In view of the foregoing disadvantages inherent in the known types of umbrella hats now present in the prior art, the present invention provides an improved foldable umbrella fan. As such, the general purpose of the present invention, which will be described subsequently in greater detail, is to provide a new and improved personal comfort device which has all the advantages of the prior art and none of the disadvantages. To attain this, the present invention comprises a pleated, collapsible shield and a support binder assembly.

The shield is constructed from a substantially rectangular or trapezoidal, water-repellant, form-retaining material. The shield has an interior end, an exterior end and a pair of opposing sides. The shield material contains a plurality of pleats running substantially parallel between the opposing sides and extending from the interior end to the exterior end. The shield is of a length sufficient to enable the user to spread open the pleated shield in a fan-like manner through a 360° planar arc until the opposing sides meet, thereby forming a circular covering. The shield also has a width which is sufficient to protect the user from rain or sun when the shield is deployed open and positioned over the wearer's head.

The support binder provides additional structural support to the pleated shield, reduces the risk of damage thereto, and aids in maintaining the positioning thereof. It comprises a pair of binder arms pivotally interconnected by a flexible binder spine. The binder arms are sized for coextensive alignment with the opposing sides of the pleated shield. Each binder arm has an inner surface which faces one of the opposing sides of the pleated shield, and an outer surface. In addition to interconnecting the binder arms, the binder spine also pivotally interconnects the pleat sections of the shield's interior end. The binder spine permits only planar, pivoting movement of the binder arms and pleated shield relative to the interior end, allowing movement of the umbrella fan between an open position, a closed position, and an intermediate fanning position.

In the closed position, the pleated shield is fully collapsed, bound by the binder arms and the binder spine. Optionally, a closed position clasp may be provided upon the binder arms to securely maintain the umbrella fan in the closed position. Like conventional foldable umbrellas, the closed umbrella fan can easily be stored in briefcases or handbags. But because the closed umbrella fan has a flat, rectangular profile, it can additionally be comfortably stored in a pocket. This makes carrying of the umbrella fan easier for persons who are not carrying briefcases or handbags. Pocket carriage also enables easier retrieval for speedy deployment.

In the open position, the pleated shield is fully deployed to form a circle, with the outer surfaces of the two binder arms in contact with each other. Optionally, a spring may be attached to the interior end of the support binder to bias the umbrella fan into the open position. Also, an open position clasp may be provided upon the support binder to securely maintain the umbrella fan in the open position. Once deployed in the open position, the umbrella fan is easily positioned over the wearer's head to shield the wearer from rain or sunshine.

Various methods are available to maintain the umbrella fan over a wearer's head. The support binder may be provided with a chin strap recess, sized to receive an adjustable length chin strap. Alternatively, a headband, a barrette, or a similar securing device may be provided upon the support binder. Additionally, the support binder may be provided with a holding area to allow the user to hold the umbrella fan over his or her head, especially useful for short outdoor dashes through the rain.

Because the flexible binder spine is the same width as the interior end of the pleated shield, when the shield is rotated into the open position, the spine will form a circular unprotected area in the center of the umbrella fan. To provide the wearer protection in this area as well, the interior end of the pleated shield is provided with a plurality of meshing tips. The meshing tips are portions of the pleated shield which extend beyond the interior end of the shield, over the binder spine. The meshing tips mesh with each other to fill the circular hole at the center of the open umbrella fan. While all of the pleat sections may possess meshing tips, filling the area of the circular hole may dictate that fewer sections be so provided. Also, the meshing tips may be of varying length, depending upon the width of the interior end and the thickness of the pleated shield material.

Due to the flexibility of the binder spine, the weight exerted by the pleated shield will cause the openly positioned umbrella fan to sag slightly into a conical shape over the head of the wearer. By adjusting the stiffness of the binder spine, cones of varying angular orientations may be achieved. Finally, the profile of the interior end of the pleated shield and the meshing tips may be tapered to anticipate the slight radial sag of the umbrella fan, to thereby cause a greater intermeshing at the umbrella fan's center and maximize the protection of the central area.

The umbrella fan is also spreadable to any partially opened orientation. Therefore, instead of fully opening the invention to wear it as an umbrella or a sun hat, the user can spread the invention partially open and use it as a fan.

Accordingly, it is a principal object of the invention to provide a foldable umbrella fan which can be used as an umbrella, a sunshade, or a fan.

It is another object of the invention to provide a foldable umbrella fan which can be worn on the head of a user so as to free both of the user's hands.

It is a further object of the invention to provide a foldable umbrella fan which can easily be held over the user's head for short outdoor dashes through the rain.

It is still a further object of the invention to provide a foldable umbrella fan which can easily be carried in a pocket when not in use.

It is yet a further object of the invention to provide a foldable umbrella fan which includes a position biasing means for biasing the invention toward a preferred position.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
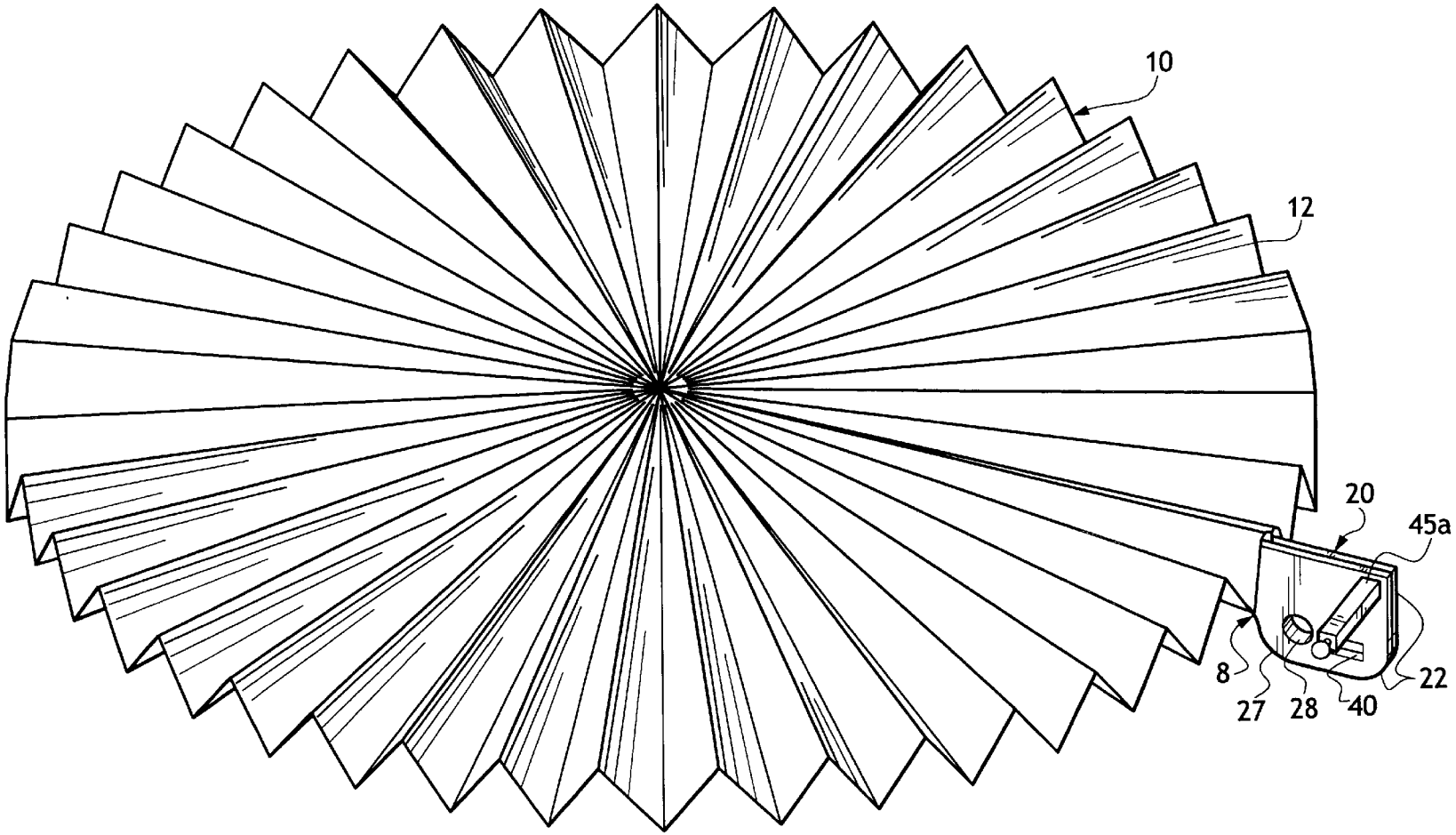
FIG. 1 is a perspective view of the foldable umbrella fan deployed in the open position.
Figure 2:
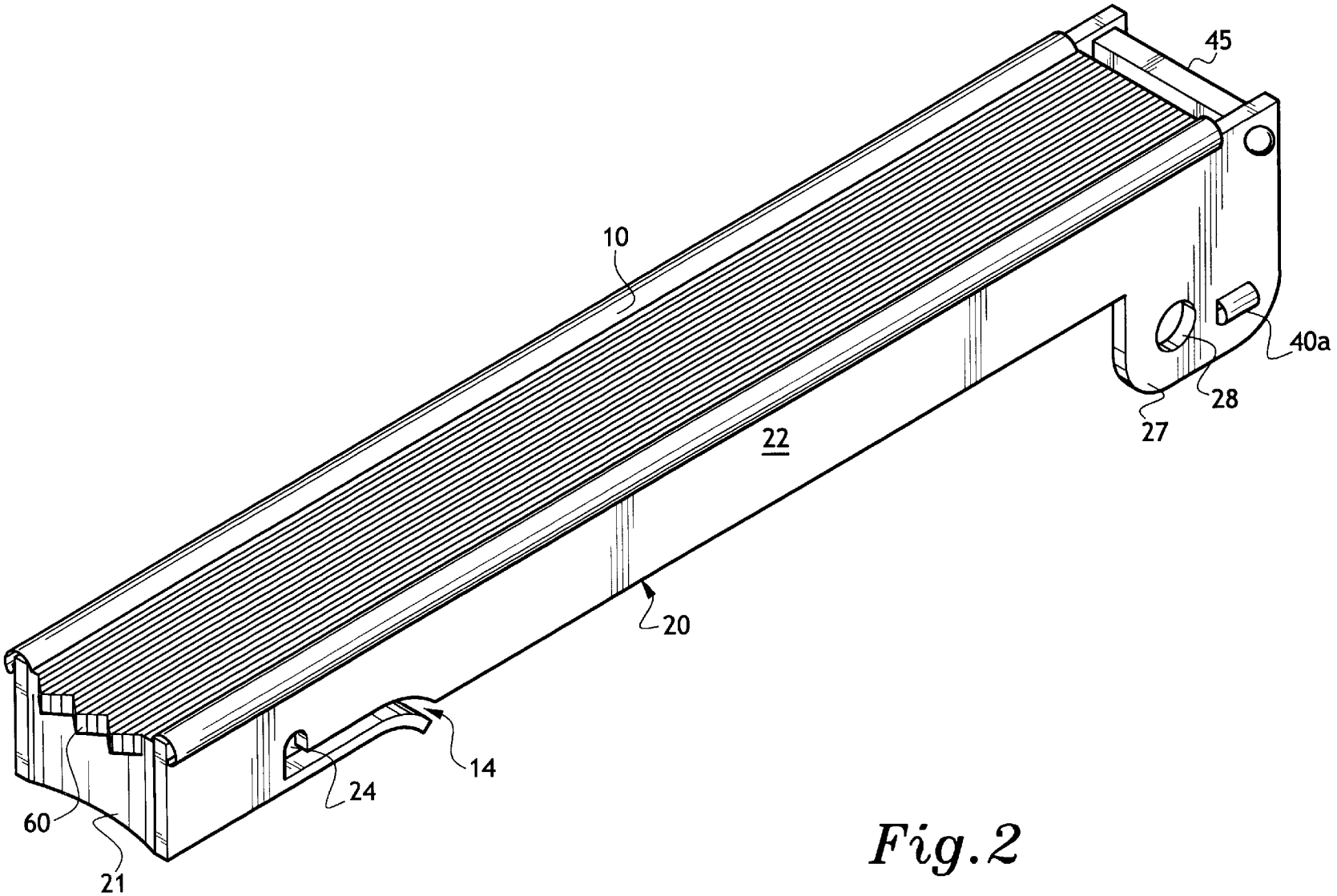
FIG. 2 is a perspective view of the invention in the closed position.

The present invention is generally directed towards a foldable umbrella fan which can be used as an umbrella, a sunshade, or a general use fan. Referring to FIGS. 1 through 5 of the accompanying drawings, a foldable umbrella fan 8 comprises two major components: a pleated shield 10 and a support binder 20.

The pleated shield 10 is constructed of a collapsible form-retaining material having an interior end 11, an exterior end 12, and a pair of opposing sides 13. A plurality of pleats extend from the interior end 11 to the exterior end 12, running substantially parallel between the opposing sides 13, and forming a plurality of pleat sections 15.

The support binder 20 comprises a flexible binder spine 21 and a pair of binder arms 22 having interior ends pivotally connected to the binder spine 21. The binder arms 22 each have an inner surface 25 and an outer surface 26, and are sized for coextensive alignment with, and attachment to, the opposing sides 13 of the pleated shield 10. The interior end of the pleat sections 15 are connected to the binder spine 21. The umbrella fan 8 is rotatable between an open position shown in FIG. 1 and a closed position shown in FIG. 2.

Figure 3:
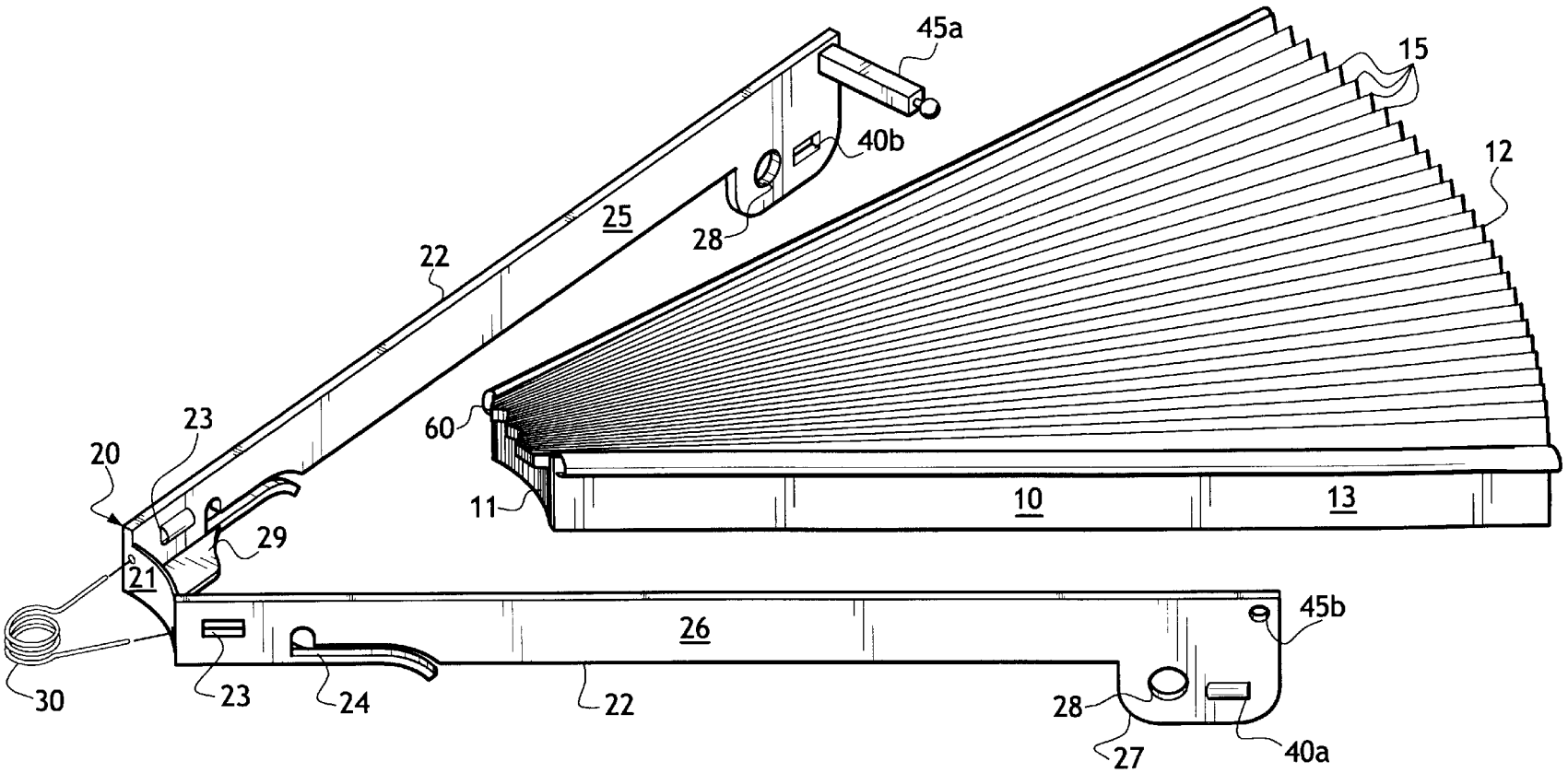
FIG. 3 is an exploded perspective view of the invention in a partially opened position, and including the position biasing means.

FIG. 3 depicts an optional position biasing means comprising a spring 30, disposed interiorly to binder spine 21, and attached to the binder arms 22 via spring receiving slots 23 for biasing binder arms 22 towards the open position, but designed and configured to maintain the invention in the partially open position shown, so that a user may employ the invention as a fan.

With further reference to FIG. 3, in the open position (seen in FIG. 1), the outer surfaces 26 of binder arms 22 are rotated into contact with each other, and the pleated shield 10 is fanned in a 360° planar arc. An open position clasp 40 comprising open clasping protrusion 40*a* and open clasping hole 40*b* securely maintains the binder arms 20 in the open position.

The support binder 20 is provided with chin strap recess 24. The chin strap recess 24 is sized to receive an adjustable chin strap 50 for securely positioning the umbrella fan upon the wearer's head. Shield guides 29 provides structural reinforcement to the binder arms 22 adjacent the chin strap recess 24. The flanged portion guides 29 also guide and protect pleated shield 10.

FIG. 3 also depicts an optional holding area 27, including a carrying hole 28, extending from support binder 20. The holding area 27 provides a means for holding the open umbrella fan 8 over the user's head without use of the adjustable chin strap 50.

In the closed position, the pleated shield 10 is fully collapsed, flanked by the binder arms 20 and the binder spine 21. Closed position clasp 45 comprises a closed clasping protrusion 45*a* depending from one of the binder arms 20 and a closed clasping hole 45*b* defined by the other binder arm 20. The protrusion 45*a* and hole 45*b* are configured and rotationally aligned so that the protrusion fits closely into the hole to frictionally overcome the force of spring 30 and thereby securely maintain the binder arms 20 in the closed position.

Figure 4:
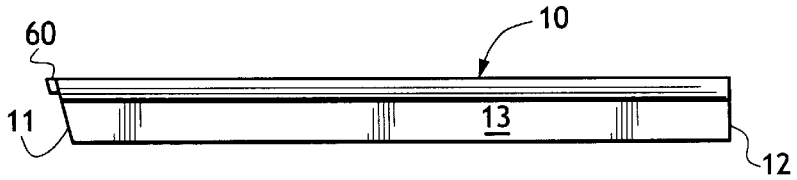
FIG. 4 is a side view showing the pleated shield's radial profile and tapered interior end.
Figure 5:
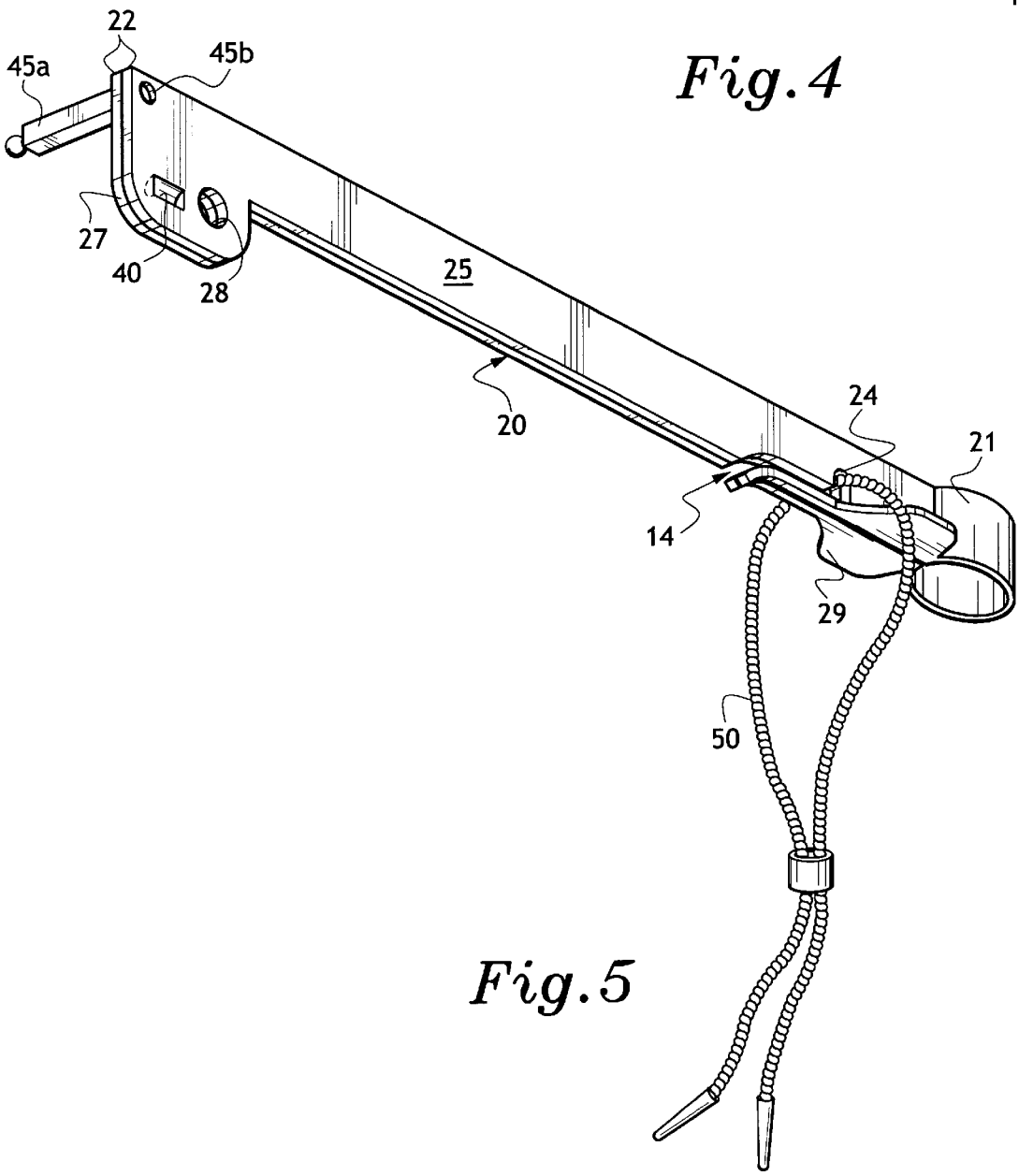
FIG. 5 is a perspective view of the adjustable chin strap attached to the openly positioned support binder.

FIG. 4 illustrates the radial profile of the pleated shield 10, and particularly illustrates the tapered profile of the interior end 11 and the interior meshing tips 60. In FIG. 3, there is shown an embodiment in which the interior meshing tips 60 are of varying length.

It is to be understood that the present invention is not limited to the embodiments described above, but encompasses any and all embodiments within the scope of the following claims.

I claim:

1. A foldable umbrella fan, comprising:

a form-retaining pleated shield having an interior end, an exterior end, a pair of opposing sides, and a plurality of pleats extending from the interior end to the exterior end;

a support binder comprising a pair of binder arms sized in coextensive alignment with, and attached to, the opposing sides of the pleated shield, each binder arm having an inner surface which faces one of the opposing sides of the pleated shield, an opposing outer surface, an exterior end, and an interior end adjacent the interior end of the pleated shield;

the support binder further comprising a flexible binder spine, the binder spine pivotally interconnecting the interior end of the pleated shield and the interior end of the binder arms for planar pivotable movement of the pleated shield and the binder arms around the binder spine; and a plurality of meshing tips disposed at the interior end of the pleated shield, said meshing tips extending beyond the binder spine at the fan center when the umbrella fan is in an open position;

wherein the umbrella fan is rotatable between the open position in which the pleats are radially arranged, a closed position in which the pleats are substantially parallel to the opposing sides, and an intermediate position in which the pleats are fanned.

2. The foldable umbrella fan according to claim 1, wherein the meshing tips are tapered for improved intermeshing.

3. The foldable umbrella fan according to claim 1, further comprising a position biasing means to bias the umbrella fan towards a desired position, said biasing means being disposed at the interior end of the support binder.

4. The foldable umbrella fan according to claim 3, wherein position biasing means are configured to establish the desired bias position as the open position.

5. The foldable umbrella fan according to claim 3, wherein the position biasing means is a spring.

6. The foldable umbrella fan according to claim 1, further comprising an open position clasp disposed at the exterior end of the support binder for securely maintaining the umbrella fan in the open position.

7. The foldable umbrella fan according to claim 6, wherein the open position clasp further comprises:

an open position clasping protrusion extending from the outer surface of one of the binder arms; and the other of the binder arms provided with an open position clasping hole disposed in rotational alignment with the open position clasping protrusion, the open position clasping hole sized for frictionally receiving the open position clasping protrusion.

8. The foldable umbrella fan according to claim 1, further comprising a closed position clasp disposed at the exterior end of the support binder for securely maintaining the umbrella fan in the closed position.

9. The foldable umbrella fan according to claim 8, wherein the closed position clasp further comprises:

a closed position clasping protrusion extending from the inner surface of one of the binder arms; and the other of the binder arms provided with a closed position clasping hole disposed in rotational alignment with the closed position clasping protrusion, the closed position clasping hole sized for frictionally receiving the closed position clasping protrusion.

10. The foldable umbrella fan according to claim 1, further comprising:

an adjustable chin strap; and wherein the support binder is further provided with a chin strap recess sized to receive the adjustable chin strap for hands-free positioning of the umbrella fan over a wearer's head.

11. The foldable umbrella fan according to claim 1, further comprising a holding area disposed upon the support binder for manually holding the umbrella fan over a user's head.

12. The foldable umbrella fan according to claim 1, wherein the support binder further possesses a carrying hole.

* * * * *